US007087895B1

(12) United States Patent
Liu et al.

(10) Patent No.: US 7,087,895 B1
(45) Date of Patent: Aug. 8, 2006

(54) ELECTROSPRAY IONIZATION USING POINTED FIBERS

(75) Inventors: Jian Liu, Charleston, SC (US); Daniel R. Knapp, Charleston, SC (US)

(73) Assignee: MUSC Foundation for Research Development, Charleston, SC (US)

( * ) Notice: Subject to any disclaimer, the term of this patent is extended or adjusted under 35 U.S.C. 154(b) by 58 days.

(21) Appl. No.: 10/862,803

(22) Filed: Jun. 7, 2004

Related U.S. Application Data

(60) Provisional application No. 60/477,105, filed on Jun. 7, 2003.

(51) Int. Cl.
*H01J 49/00* (2006.01)

(52) U.S. Cl. ..... 250/282; 250/288; 250/281

(58) Field of Classification Search ..... 250/288, 250/292, 281, 282
See application file for complete search history.

(56) References Cited

U.S. PATENT DOCUMENTS

| | | | | |
|---|---|---|---|---|
| 5,824,026 | A * | 10/1998 | Diaz | 607/116 |
| 5,836,946 | A * | 11/1998 | Diaz et al. | 606/45 |
| 6,670,607 | B1 * | 12/2003 | Wood et al. | 250/288 |
| 6,764,720 | B1 * | 7/2004 | Pui et al. | 427/479 |
| 2002/0003209 | A1 * | 1/2002 | Wood et al. | 250/282 |
| 2004/0206399 | A1 * | 10/2004 | Heller et al. | 137/375 |
| 2005/0064168 | A1 * | 3/2005 | Dvorsky et al. | 428/292.1 |
| 2006/0057556 | A1 * | 3/2006 | Janini et al. | 435/4 |

* cited by examiner

*Primary Examiner*—Nikita Wells
*Assistant Examiner*—Johnnie L Smith, II
(74) *Attorney, Agent, or Firm*—B. Craig Killough

(57) ABSTRACT

A pointed carbon fiber electrospray ionization emitter has a length of electrically conductive fiber that is present within a lumen of a microfluidic device, and protrudes from the terminus. A point is present on an end of the electrically conductive fiber, or the electrically conductive fiber is otherwise sufficiently small on the end to create a desired spray. A conductor supplies electrical current to the electrically conductive fiber. Fluid to be sprayed is transported through the lumen and out of the terminus of the lumen, and an electrical field established by the conductive fiber distributes and sprays the fluid. The emitter is rugged and is able to generate stable electrospray over a wide range of flow rates, voltages, and surface tension variations.

19 Claims, 1 Drawing Sheet

ELECTROSPRAY IONIZATION USING POINTED FIBERS

Applicant claims priority from U.S. Provisional Application Ser. No. 60/477,105 filed Jun. 7, 2003.

This invention was made with government support under Grant number R21-CA86285, Contract N01-HV-28181 awarded by National Institutes of Health. The government has certain rights in the invention.

FIELD OF INVENTION

This invention relates to electrospray devices and processes as used in microfluidic analytical systems.

BACKGROUND OF THE INVENTION

Microfluidic analytical systems have been a subject of increasing interest in recent years, particularly for the analysis of biomolecules. Devices have been reported using high performance liquid chromatography, electrophoreses, isoelectric focusing, and electrochromatography separations with photometric, fluorometric, electrochemical, and mass spectrometric (MS) detection methods. Applications of MS detection have been focused upon electrospray ionization (ESI), and several groups have reported the development of microfluidic systems for interfacing to ESI-MS.

Some of the earliest work described electrospray directly from microfluidic channels opening at the edge of a glass device. This approach was complicated by the tendency to accumulate a droplet at the exit that formed a mixing volume and degraded the resolution of the separation system on the device. Most of microfluidic devices interfaced to ESI-MS, however, have utilized conventional electrospray emitters (e.g. tapered fused silica capillaries) attached to the device. This approach yields satisfactory electrospray ionization performance, but has two problems: (i) the potential for dead volume in the attachment leading to degradation of separation quality, and (ii) the loss of the key advantage of photolithography-based microfabrication methods, i.e. the ability to make multiples of a function as easily as producing a single function on a device.

A few research groups have reported microfabricated electrospray ionization sources as an integral part of the device. One research group developed silicon nitride and parylene electrospray emitters microfabricated on silicon devices. An electrospray ionization emitter for an isoelectric focusing device has been constructed on polycarbonate plates using laser micromachining method. Recently, electrospray nozzles have been fabricated from a monolithic silicon substrate. These microfabricated electrospray ionization devices gave good electrospray performance, but all of them require relatively complex processes and facilities to produce the devices.

An object of the invention is to produce a microfluidic device for ESI-MS analysis, such as the analysis of peptides and proteins. Another object is to produce inexpensive, disposable devices for high throughput proteomics work. The electrospray emitter should be resistant to clogging, enhance durability and reliability, and extend the emitter's useful life and its range of applicability. The electrospray ionization efficiency should be at least comparable to conventional nano emitters, and should be useful in interfacing micro column liquid chromatography to mass spectrometry.

SUMMARY OF THE INVENTION

A pointed carbon fiber electrospray ionization emitter for nanoliquid sampling is presented. A length of electrically conductive fiber is present within a lumen of a microfluidic device. A point is present on an end of the electrically conductive fiber, or the electrically conductive fiber is otherwise sufficiently small on the end to create a desired spray. A conductor supplies electrical current to the electrically conductive fiber. Fluid to be sprayed is transported through the lumen and out of the terminus of the lumen, and an electrical field established by the conductive fiber distributes and sprays the fluid. The conductive fiber produces a small Taylor cone at the tip of the conductive fiber, which generates a stable electrospray. The small Taylor cone improves the electrospray efficiency, thereby enhancing sensitivity. This emitter is rugged, and is able to generate stable electrospray over a wide range of flow rates, voltages; and surface tension variations.

DETAILED DESCRIPTION OF THE PREFERRED EMBODIMENT

Figure 1:
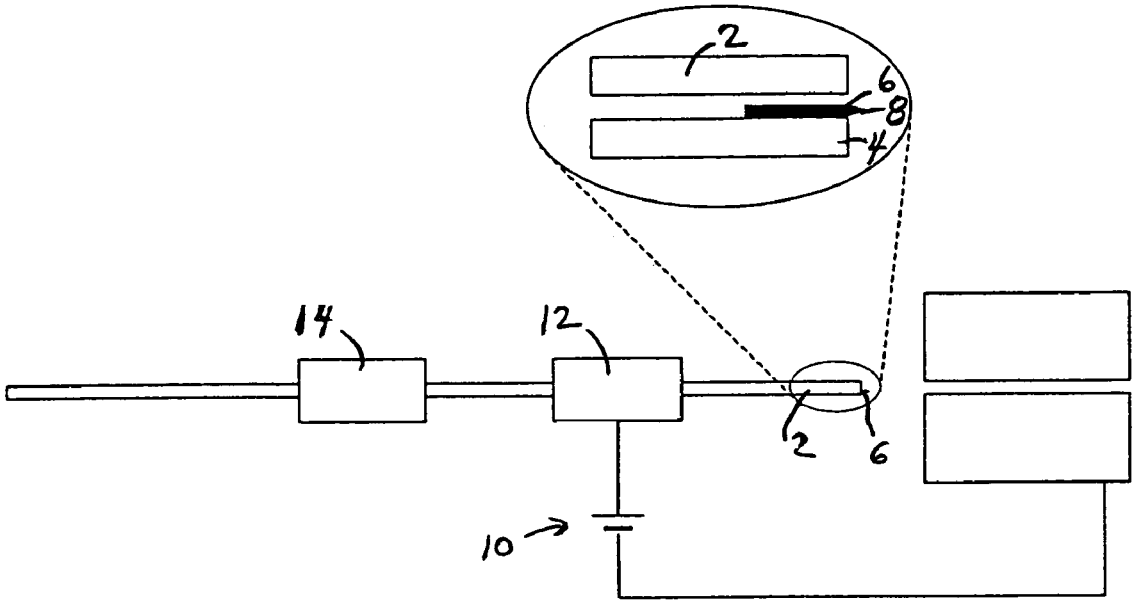
FIG. 1 is a schematic of an embodiment of the electrospray emitter of the present invention, with a cross section of the electrospray emitter isolated and enlarged.

In the embodiment of the invention shown in FIG. 1, an electrospray emitter is constructed from a length of tubing 2. The tubing may be a fused silica capillary. At the emitter terminus 4 of the tubing or capillary, a length of conductive material or conductive fiber 6 is inserted into a lumen of the tubing. The conductive fiber is preferred to be carbon fiber. The carbon fiber may have a diameter of 35 μm or less. The position of the conductive fiber is fixed relative to the tubing. Carbon fiber may be fixed with carbon ink adhesive, or the carbon fiber may be embedded in the tubing. The conductive fiber, such as carbon fiber, protrudes from the tubing terminus. For example, the carbon fiber may extend from the tubing up to 1 mm or more.

The protruding carbon fiber has a pointed shape on an end 8 that is opposite the tubing. The point may be formed, such as by etching a piece of carbon fiber. The point is formed to be sufficiently "sharp" so that sufficient electrical potential is generated to form electrospray from electrical current applied to the conductive fiber.

The point of the carbon fiber may protrude up to 50 μm from the tubing terminus. Alternatively, the pointed end of the carbon fiber may be present within the lumen of the tubing.

In another embodiment, the conductive fiber, which may be carbon fiber, is of small diameter, and is preferably less than one (1 μm) micron, so that the conductive fiber has a small dimension at the end thereof, such as the end that is opposite the tubing, without the necessity of forming a point on the relevant end of the fiber. This embodiment is referred to as having a nano fiber, which may be carbon fiber, as the conductive fiber. The nano fiber is sufficiently small to generates sufficient electrical potential to form electrospray from the fluid when electrical current is applied to the conductive nano fiber.

A conductor may be provided that connects the conductive fiber to a current source. The conductor may be known conductors, or the assembly may be coated with a conductive material. It is preferred that highly conductive materials are used to form the conductor. The conductor may be formed by coating the assembly with gold. Additionally, or alternatively, when electrically conductive fluids are transported through the tubing, current may be supplied to the conductive fiber by applying a current to the fluid as it is transported through the tubing and to the conductive fiber.

In use, current from a high voltage power supply 10 (such as 2.5 kV) may be applied to a gold-coated emitter or nano emitter, through which an analyte solution flows. A front stainless steel 12 union holds the emitter and contacts to the high voltage power supply. Another stainless steel union joins the emitter to a capillary tubing 14 or monolithic column via a PEEK sleeve.

The gold coating on the emitter is used for electric conduction of the electrospray ionization potential to the carbon fiber. The gold layer was covered by a perfluoralkyl film, in order to provide a hydrophobic character to the gold surface at the capillary exit. During electrospray ionization operation, the base of the Taylor cone is confined to the inside diameter of the fused silica capillary.

The device confines nucleation at the sharp point, and therefore generates a stable and controllable electrospray ionization process. As a result, a stable and symmetric Taylor cone is produced, operating in the voltage range from 1500–4500 V at the infusion flow rate from 0.05–5.0 μL/min.

Comparing to the conventional nanospray emitters, the device of the present invention shows good long-term and short-term stability for electrospray ionization. The emitter of the present invention is a robust emitter, suitable for long-term electrospray ionization applications, such as interfacing with low flow-rate chromatography.

The emitter of the present invention is tolerant to the variations in electrospray ionization conditions. The Taylor cone steadily envelops the carbon fiber tip and generates a smooth charge separation, even when sample infusion flow rate changes in a range from 0.05–5.0 μL/min. The infusion flow rate is controlled by the pumping speed of the liquid. A benefit of the present emitter is that the electric contact area between liquid and conductive tip is much larger than the conventional nanospray emitters. That means, to achieve the same electrospray ionization efficiency, the size of the emitter aperture is not as critical as with a nanospray emitter. The relatively larger aperture size of the present emitter reduces the risk of clogging, and facilitates use as a reliable emitter for low flow rate and highly sensitive electrospray ionization. For an electrode of fixed area, the charge transfer process is rapid relative to the rate of diffusion. In the case of electrospray ionization, the portion of the metal-solution contact area at which oxidation occurs may increase back from the area closest to the tip as the current increases. This indicates that an increased electrode area can increase the current. The analyte solution contact area (effective electrode area) of the conductive (carbon) fiber tip, at least the carbon cone part, is larger than a normal nano emitter (a ring edge), which appears to enhance discharge efficiency.

The present emitter will operated for long periods without degradation of gold coating. The contact area between analyte solution and the conductive surface is increased, and consequently, the efficiency of direct heterogenous electron transfer reactions and the electrochemical oxidation rate are increased. As a result, the charge separation is enhanced. While the carbon fiber may be eroded by the electrochemical oxidation during electrospray ionization, it does not significantly change the emitter surface area and properties, and thereafter the discharge conditions.

The rate of charge separation is a function of the rate of influx of analyte, not the field strength. For a fixed current, a smaller electrode area means a higher current density. The current in the gap is determined by the rate of charge separation at the emitter tip. This proportionally relates to the electrospray ionization efficiency. For the same electrospray ionization efficiency, a larger contact area between conductive surfaces to the sample solution leads to lower current density. The larger bigger contact area yields relatively low current density, and extended lifetime.

The protruded sharp carbon fiber guides an extremely stable charge separation at the emitter tip point. The hydrophobic surface around the lumen restricts the Taylor cone bottom to the inner diameter of the exit. This shrunken Taylor cone improves the electrospray performance thereby enhancing the detectability of ESI/MS.

What is claimed is:

1. An electrospray emitter, comprising:

a) a microfluidic device having a lumen therein, wherein said lumen communicates with a fluid source, and a fluid is transported from said fluid source through said lumen;

b) an electrical current source; and c) an electrically conductive fiber positioned near an opening of said lumen, wherein said electrically conductive fiber contacts said fluid prior to said fluid being formed into an electrospray, and wherein an electrical current applied to said conductive fiber from said electrical current source generates sufficient electrical potential at an interface between said fluid and said electrically conductive fiber to form electrospray from said fluid.

2. An electrospray emitter as described in claim 1, wherein said electrically conductive fiber is present within an interior of said lumen and said electrically conductive fiber extends from said interior of said lumen to beyond an opening orifice of said lumen and outside of said lumen.

3. An electrospray emitter as described in claim 1, wherein an electrical conductor is attached to said electrically conductive fiber and to said electrical current source.

4. An electrospray emitter as described in claim 1, wherein an electrical conductor is coated over at least a portion of microfluidic device and said electrical conductor communicates with said electrically conductive fiber and said electrical current source.

5. An electrospray emitter as described in claim 1, wherein said electrically conductive fiber is elongated.

6. An electrospray emitter as described in claim 1, wherein current from said electrical current source is provided to said electrically conductive fiber by said fluid.

7. An electrospray emitter as described in claim 1, wherein said lumen has a cross sectional diameter at said opening that is not greater than 0.5 mm.

8. An electrospray emitter as described in claim 1, wherein said electrically conductive fiber is a carbon fiber.

9. An electrospray emitter as described in claim 1, wherein said electrically conductive fiber is an elongated fiber having a diameter that is not greater than 100 microns.

10. An electrospray emitter as described in claim 2, wherein said electrically conductive fiber has a point formed on an end of said electrically conductive fiber that is opposite an end of said electrically conductive fiber that is in said interior of said lumen.

11. An electrospray emitter, comprising:

a) a microfluidic device having a lumen therein, wherein said lumen communicates with a fluid source, and a fluid is transported from said fluid source through said lumen;

b) an electrical current source; and c) an elongated and electrically conductive fiber positioned near an opening of said lumen, said electrically conductive fiber having a fiber having a diameter of one (1) micron or less.

12. An electrospray emitter as described in claim 11, wherein said electrically conductive fiber is present within an interior of said lumen and said electrically conductive fiber extends from said interior of said lumen to beyond an opening orifice of said lumen and outside of said lumen.

13. An electrospray emitter as described in claim 11, wherein an electrical conductor is attached to said electrically conductive fiber and to said electrical current source.

14. An electrospray emitter as described in claim 11, wherein an electrical conductor is coated over at least a portion of said microfluidic device.

15. An electrospray emitter as described in claim 5, wherein said electrically conductive fiber has a point formed on an end thereof, and said point extends forward of said opening of said lumen.

16. An electrospray emitter as described in claim 11, wherein current from said electrical current source is provided to said electrically conductive fiber by said fluid.

17. An electrospray emitter as described in claim 11, wherein said lumen has a cross sectional diameter at said opening that is not greater than 0.5 mm.

18. An electrospray emitter as described in claim 11, wherein said electrically conductive fiber is a carbon fiber.

19. An electrospray emitter as described in claim 11 wherein said electrically conductive fiber has a point formed on an end thereof, and said point extends forward of said opening of said lumen.

* * * * *